United States Patent [19]

Fairbanks, Jr. et al.

[11] 4,017,377

[45] Apr. 12, 1977

[54] PROCESS AND FLUID MEDIA FOR TREATMENT OF TAR SANDS TO RECOVER OIL

[76] Inventors: John B. Fairbanks, Jr., 3927 S. 3030 East, Salt Lake City, Utah 84106; Gary C. Brimhall, 2915 Branch Drive, Salt Lake City, Utah 84117

[22] Filed: Sept. 18, 1975

[21] Appl. No.: 614,612

Related U.S. Application Data

[63] Continuation-in-part of Ser. No. 462,206, April 19, 1974, abandoned.

[52] U.S. Cl. ..... 208/11 LE

[51] Int. Cl.[2] ..... C10G 1/04

[58] Field of Search ..... 208/11 LE

[56] References Cited

UNITED STATES PATENTS

| | | | |
|---|---|---|---|
| 2,825,677 | 3/1958 | Conlson | 208/11 LE |
| 2,903,407 | 9/1959 | Fischer et al. | 208/11 LE |
| 3,300,405 | 1/1967 | Black | 210/21 |
| 3,547,803 | 12/1970 | Barkman et al. | 208/11 LE |
| 3,553,100 | 1/1971 | Jorda et al. | 208/11 LE |
| 3,644,194 | 2/1972 | Kelly et al. | 208/11 LE |
| 3,660,268 | 5/1972 | Kelly et al. | 208/11 LE |

*Primary Examiner*—Delbert E. Gantz
*Assistant Examiner*—James W. Hellwege

[57] ABSTRACT

Process, structure, and aqueous bath for recovering oil from tar sand, known also simply as oil sand. The process includes the steps of passing the tar sand through, or subjecting the same to a diluent, to reduce the internal fluid friction or viscosity of the oil layers surrounding each sand particle, and then bringing together the "sand", i.e. the sand particle plus its thinned oil layer, and an aqueous bath having a slightly raised specific gravity and also a wetting agent. The purpose for the wetting agent is to allow the sand particles to fall to the bottom of the processing tank as sludge. The raised specific gravity of the water, which is still substantially less than that of sea water, by the Archimedes' principle, causes the released globules or droplets of oil to be accelerated rapidly to the surface of the water, thereby escaping recapture or admixture with the descending sand particles. The now dilute oil is recovered, separated, and the diluent is reused in the tank. In-situ recovery by the above process and bath is likewise practicable.

8 Claims, 1 Drawing Figure

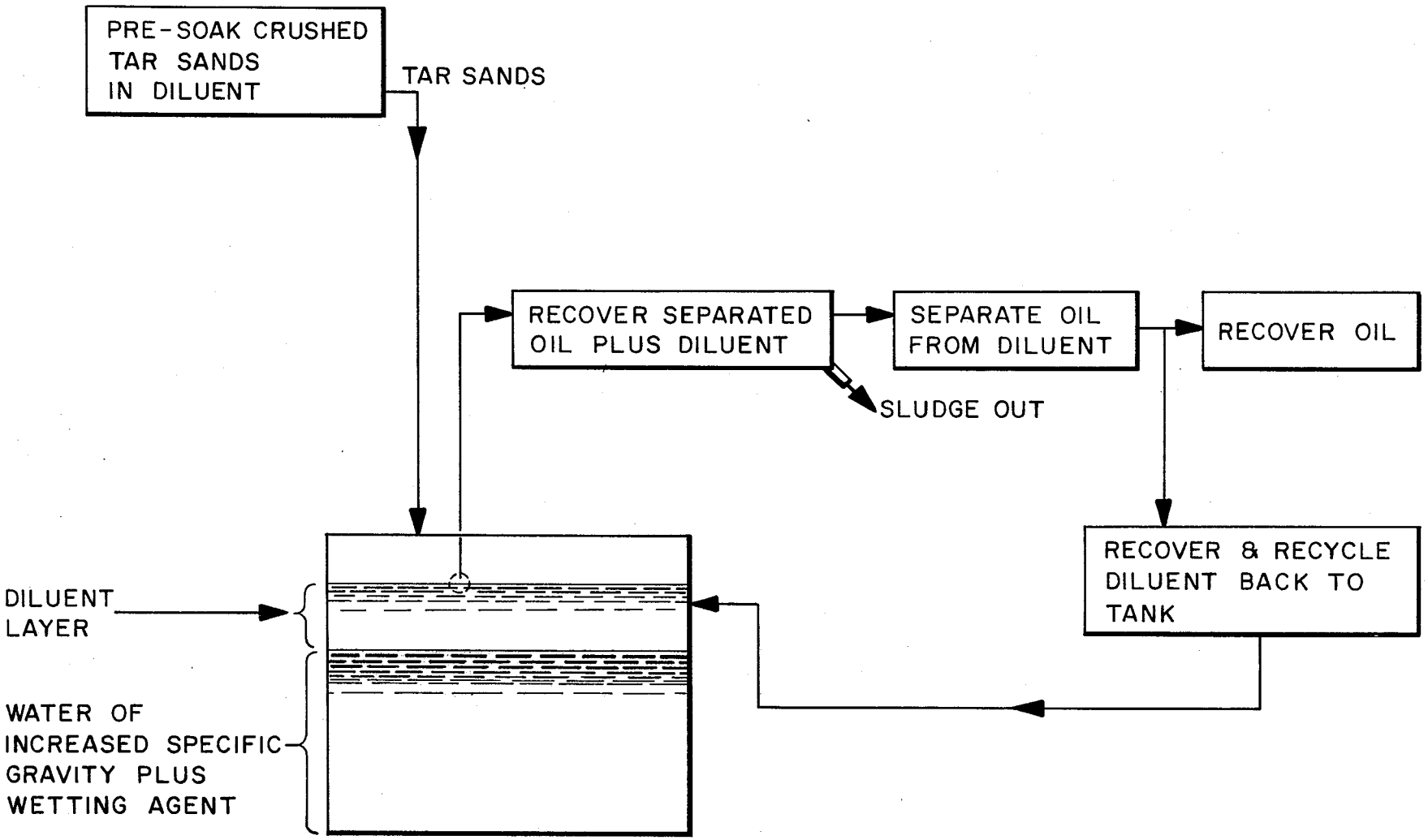
PRE-SOAK CRUSHED TAR SANDS IN DILUENT
TAR SANDS
RECOVER SEPARATED OIL PLUS DILUENT
SLUDGE OUT
SEPARATE OIL FROM DILUENT
RECOVER OIL
RECOVER & RECYCLE DILUENT BACK TO TANK
DILUENT LAYER
WATER OF INCREASED SPECIFIC GRAVITY PLUS WETTING AGENT

PROCESS AND FLUID MEDIA FOR TREATMENT OF TAR SANDS TO RECOVER OIL

This is a continuation-in-part of copending patent application entitled "PROCESS AND FLUID MEDIA FOR TREATMENT OF TAR SANDS TO RECOVER OIL", Ser. No. 462,206, filed Apr. 19, 1974 and now abandoned.

The present invention relates to processes concerned with the separation of bitumen or oil from tar sands.

Tar sands have been studied extensively over the past two decades. It has been found that elemental tar sands will respectively comprise a sand particle encased in a water droplet, which in turn is provided with a spherical, bitumen or tar oil layer disposed about the sand and water. The bitumen may vary in character, depending upon where the tar sands are found.

In any event, prior processes concentrate upon the application of hear in bursting the bubble of water about the tar sand particle so as to "explode" the bitumen bubble for separate capture. The necessity for the application of heat prevents a number of problems, not the least of which is expense. Also, because many of the fields are remote, accessible fuel supplies may not be available, or, if the recovered bitumen itself is used as fuel, the output is just that much reduced.

Prior art processes are illustrated by the following United States patents:

| | |
|---|---|
| No. 2,903,407 | (Fischer) |
| No. 3,300,415 | (Black) |
| No. 3,547,803 | (Barkman) |
| No. 3,644,194 | (Kelly) |
| No. 3,660,268 | (Kelly) |

The approach of U.S. Pat. No. 3,547,803 has been simulated as in the case of utilization of brine or sea water which approximates a specific gravity of 1.07, but the use of sea water precludes the settling out of silt and other fine granular matter; instead, a murky solution-like substances obtains which appears to preclude the generation of froth, despite attempts at aeration. In any event, elevations in temperature beyond that disclosed herein renders oil droplet recovery, even though such were recoverable therein, somewhat sticky, having a tendency to remain with the diluent as a brownish impurity. This precludes the clean-separation recovery accomplished in the present invention and also lowers usage of the diluent through needed recirculation, and this in addition to experienced loss of some of the water-soluble oils.

As to aqueous recovery systems using normal water, much of the oil, even though separated from the sand by heat, will often sink and form part of the sludge that is removed from any operation system.

Also, there has been the problem heretofore of maintaining the fluid oil droplets in a separated condition relative to the sands, even after the heat separation takes place.

In the prevent invention no heat is needed in the method in order to separate the bitumen or tar oil, hereinafter referred to as "oil", from the tar sand particles. In fact, the process works best in cold water, a practical limit of operation is where the ambient water temperature does not exceed 100° F. and preferably where the water temperature does not exceed 90° F.

Water temperatures above this cause recovered oil to become sticky and to prevent maximum recycling of diluent used since the latter will tend to carry the oil and, at such high temperatures, becomes brownish in color. Initial separation of oil from the sand is accomplished by a thinning of the bitumen or oil cover of each sand particle prior to the acqueous separation. The now dilute oil from the so-called sand particles are introduced in an aqueous bath of ambient temperature condition, i.e. not greater than 100° F., wherein the specific gravity of the water has been raised slightly, as indicated hereinafter, and a wetting agent introduced therein. The purpose for the inclusion of the wetting agent is to effect a dropping out or separation of the sand particle nuclei so as to cause a freeing of the dilute bitumen or oil. The purpose for raising the specific gravity of the water in the bath is to cause a rapid upward acceleration of freed oil droplets so that a maximum separation of oil from sand particles is achieved. Thus, the specific gravity of the water will be between that of the oil and that of the sand particles dropping out.

The pre-mixing of the diluent with the tar sands can be accomplished in a separate premix step. Another way that is providing successful experimentally is simply to drop the tar sands through a diluent layer as may be disposed on top of the water bath. A third way is to combine both the premix or pre-soak step with the step of dropping the now soaked tar sands through an upper diluent layer carried by the water.

Whatever one of the above approaches is used, the wetting agent's function in penetrating the thinned oil layer of the sand particles and in freeing the water layer and ultimately the sand particles themselves, for droppage as slude into the tank, plus the rapid acceleration induced in the now-freed oil droplets as caused by the increased specific gravity of the water, assures an essentially complete separation of oil from sand and enables optimum oil recovery proximate the surface of the aqueous bath.

As to the wetting agent, sodium silicate is preferably used; optionally, Treato-lite or another type of wetting agent may be employed.

In making the water heavier, preferably soda ash, known generally as anhydrous sodium cabonate is used. Optionally, common table salt, i.e. sodium chloride, might be used, howbeit considerably less effectively.

As to the diluent, naptha and/or gasoline are preferred since the low-boiling character of these petroleum fractions enable a self-vaporization possible without the application of heat, therefore facilitating automatically a clean separation of recovered oil from diluent. Other suitable diluents are stove oil, diesel fuel, and kerosene.

In-situ recovery may also be practised.

Accordingly, a principal object of the present invention is to provide a new process for treating oil sands or tar sands, as they are known, to free and separately recover the oil therefrom.

A further object is to provide a new and improved tar sand, oil recovery process which does not require the application of heat.

an additional object is to provide a process for recovering bitumen from tar sands wherein oil is freed from its particles and ensured clean separation from particles as it ascends into an appropriate diluent bath.

A further object is to provide an aqueous solution for the recovery of oil from tar sands.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

The sole FIGURE represents a schematic diagram of the process of flow sheet of one embodiment of the present invention. Either the separate pre-soak step or the aqueous bath's diluent layer may be deleted as aforesaid, if desired.

In the present invention, as shown in the drawing, a preferred initial step is to pre-soak crushed tar sands in a diluent. The diluent may comprise one or more of the following by way of example, naptha, regular gasoline, diesel oil, stove oil, kerosene, and so forth. The lighter diluents such as naptha and regular gasoline are much preferred since much less is needed of these lighter fractions; furthermore, these will tend to vaporize at customary ambient temperatures so that a clean separation of diluent from recovered oil, as hereinafter desribed, may be obtained without the application of heat. Of course, if one chooses to apply some heat at the separation step, to accelerate separation of diluent from oil, he may still do so within the purview of the invention.

It is convenient to use the same type of diluent or mixture of diluents in both the pre-soak equipment utilized for such initial first step and also at the diluent region in the process tank as disclosed.

It is noted that crushed tar sands are introduced in this initial step. This should be of the order such that a majority of the pieces are less than 1½ inches in maximum rectilinear dimension. Of course, the finer the sands are crushed, and even ground, the greater the rate of throughput possible. Also, if the sands are crushed such that a majority of the same pass, say, a minus 10 screen mesh, then the sands may be directly introduced advantageously into the process tank without a prior pre-soaking. Nevertheless, even here a pre-soak, from perhaps a few seconds to one half hour, is desirable to obtain a maximum recovery at a maximum throughput rate.

In any event, we now come to the primary step which is to introduce the tar sands into the process tank such that the same progressively fall through the diluent layer contained in such process tank, to achieve disposition in the lower aqueous region of the tank. Here, the diluent layer, if employed, may comprise one or a mixture of known solvents, but preferably consists of naptha, gasoline, or a combination of the two. It has been found that the lighter the specific gravity of the diluent used, the greater effect in decreasing the viscosity of the oil layer surrounding each sand particle.

As to the aqueous region within the process tank, the same should have an increased specific gravity over that of plain water ($H_2O$), i.e. 1 gm/ml. A preferred way of increasing the specific gravity of the water is to introduce soda ash therein, namely, anhydrous sodium carbonate. The proportion by volume should be 1 ml. of soda ash to 280 ml. $H_2O$. The so-called "light" soda ash is used having a density of 49.5 pounds per cubic feet. Permissible variations are from 0.2–2.8 ml. of soda ash for each 280 ml. of plain water. Of course, common table salt may be employed, but this has proven experimentally less satisfactory than the utilization of soda ash. The water must be less than 100° F. in temperature and preferably less than 90° F. The most desirable results are obtained where simply cold or tap-temperature water is used, this so that the released oil droplets will not disperse through the diluent employed.

Rather than using a specific gravity raising salt, as above explained, heavy water ($H_2O_2$) may be used, howbeit considerably less effectively.

Also to be added to the water in the tank is a wetting agent such as sodium silicate or a substance known by the tradename Treato-lite, by way of example. Sodium silicate is preferred. The sodium silicate employed is a sodium silicate aqueous solution having the following characteristics:

1.401 specific gravity
41.5 Baume
11.67 lbs./bal.
38.3% solids

It has been found that the range of permissible usage of the sodium silicate solution is quite restricted and should be from 6–12 drops per 8 oz. of water, 20 drops thereof equalling 1 ml. or 1.36 grams.

As to the soda ash additive, making the specific gravity of the water greater than 1, the same is added such that the specific gravity of the final solution is much less than that of brine or sea water (1.07) and indeed cannot exceed 1.01. If such a figure is exceeded, then there is no clean separation of oil from silt and sand since the silt present is precluded from sinking to the bottom of the container.

The wetting agent has proven in experimentation to serve uniquely in permitting the sand particles of the tar sands to drop to the bottom for withdrawal as sludge.

The function of the diluent layer in the tank is to further lower the specific gravity and decrease the viscosity of the spherical oil layer, and this immediately prior to entrance of the oil sand particles in the aqueous region. When the sand falls into the aqueous region, the wetting agent coacts with the diluent-plus-oil droplets in effectively freeing the spherical oil layer from the water layer that encases the sand particle. Such wetting agent has been found extremely effective, during such separation, in thus effectively freeing the sand particles from the released oil droplets so that the sand immediately falls to the bottom of the tank. The increased specific gravity of the water is relied upon to ensure that the now formed oil droplets bubble upwardly very rapidly and therefore ascent immediately to the diluent region of the tank. If the water's specific gravity had not been raised, much of the oil would actually descend in an admixture state with the sand to the bottom of the tank. Optimum results are achieved when the wetting agent such as sodium silicate is of the ratio of 4 ml. to each 280 ml. of water.

Subsequent steps are shown in the drawing. Thus, the oil plus diluent are recovered and then separated into respective fractions of oil and diluent. This may be accomplished simply by the natural vaporization of the diluent from the oil under ambient conditions.

Final steps are to separately recover the oil and also to recover and recycle the diluent back to the process tank.

The following tests made are illustrative:

Uniform amounts of crushed tar sands, approximately filling an 8-oz. cup, were placed in each of 6 containers labeled No. 1-No. 6.

114 ml. of clear diesel fuel as a diluent was premixed with the tar sands. Then 116 ml. of an aqueous solution (No. 1) was added to containers No. 5 and No. 6 and the latter agitated for 30 seconds. The aqueous solution contained one drop, per ounce of water, of 40% sodium silicate solution and ⅛ oz. of soda ash per gallon of water. (here equalling a specific gravity of 1.001).

In a separate container 50 ml. of Great Salt Lake brine water was diluted to 150 ml. of cold tap water to approximate the concentration of ocean water, and this (No. 2 solution) was added to containers No. 2 and No. 3 which were agitated for 30 seconds.

All containers were allowed to stand for approximately 3 minutes. 160 ml. of warm solution (No. 1) above described, at 90° F. was added to container No. 4 and such container agitated for 30 seconds. Agitation was used to shorten the time of stratification and separation.

Containers No. 5 and No. 6 received additions of the above described (No. 1) aqueous solution, including the soda ash and sodium silicate as aforesaid.

Container No. 1 received 150 ml. of warm, equivalent ocean water (No. 2) and agitated for 30 seconds.

All containers were then allowed to stand for 3 minutes.

The following results were obtained:

Containers No. 5 and No. 6 showed clear separation and stratification of oil at the top, clear water in the center, and fairly clean white sand at the bottom.

Container No. 4 showed excellent clean separation and stratification of tar and oil on top, clear water in the center, and fairly clean white sand at the bottom.

Containers 1, 2, and 3 showed slight incomplete separation, sands were not clean in appearance, and the water and oil emulsion which resulted did not separate.

The crux of the present invention, therefore, is to provide a solvent whereby to reduce the viscosity and specific gravity of the oil trapped in a tar sand particle, and then raising the specific gravity of the water bath such that its specific gravity is between that of the now dilute oil and that of the sand particle. Hence, upon supplying the necessary wetting agent to effect an initial separation of the sand particle from the oil, then the dilute recovered oil bubbles rapidly upwardly through the water, whereas the sand drops down. The lighter the diluent, such as naptha, the more effective the separation.

The subject invention therefore provides a novel method and composite agent whereby oil may be recovered from tar sands in an inexpensive manner and without the application of heat at the process tank step. The character of the water bath within the tank is such as to assure, by virtue of the Archimedes' principle, that the freed oil droplets are rapidly accelerated upwardly to the diluent layer contained within the tank so that these droplets are not carried down by descending sand particles. Further, the sand particles themselves are initially separated, and are retained in their separate conditon by virtue of the wetting agent as aforesaid.

Thus, the basic feature of the invention is in the process of introducing tar sands into an aqueous solution of specific gravity greater than one and also having a wetting agent. As to the diluent needed, the same may be either premixed with the crushed tar sands, or comprise an upper layer disposed over the aqueous bath, or both. Finally, an advantage appears to exist where there is an admixture of diluent with the sands immediately prior to entrance of the sands into the water bath; hence, some preference is given to practising the method where the aqueous bath has a diluent layer disposed thereover.

Where in-situ recovery is to be practised, as by production of a rubble chimney below grade, then the above described aqueous solution may simply be pumped into the fractured tar sand area. The viscosity of the sand in its natural state, in possibility, can be sufficient such as to producing a bubbling upwardly of recoverable oil from the tar sand deposit therebelow. Where the deposit is of the usual hard or dense-bitumen nature, then one of the above diluents can be pumped first down into the tar sand area, such step being followed by a pumping down or other introduction of the aforesaid aqueous solution or bath in such area.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

We claim:

1. A process for recovering oil from tar sands including the steps of: providing tar sands; subjecting initially said tar sands to a non-aqueous, hydrocarbon, tar-oil viscosity-reducing diluent environment; providing a separating tank having an aqueous bath of ambient temperature condition not exceeding 100° F. and with a specific gravity greater than one but not exceeding 1.01, said aqueous bath including a wetting agent; directly introducing, for settling, said tar sands, containing diluent from said environment, into said aqueous bath immediately after said subjecting step, whereby to release oil from said tar sands to float upwardly in said bath in a quiescent area thereof; and recovering said oil.

2. The method of claim 1 wherein said aqueous bath has a diluent layer disposed thereover, said subjecting step comprising dropping said tar sands into and through said diluent layer.

3. The method of claim 1 wherein said aqueous bath is provided with an upper diluent layer, said subjecting step itself comprises the successive steps of, first, separately premixing said tar sands with diluent and, second, dropping said tar sands through said upper diluent layer.

4. The process of claim 1 wherein said diluent zone comprises at least one of the class of diluents consisting of gasoline and naphtha.

5. The process of claim 1 wherein said aqueous bath includes, for increasing said specific gravity, sodium carbonate in amount of the order of ⅛ ounce per gallon $H_2O$.

6. The process of claim 5 wherein said aqueous bath includes, as said wetting agent an equivalent of 41.5 Baume sodium silicate solution in quantity of from 6 to 12 drops per 8 oz. of water.

7. The process of claim 6 wherein the volumetric proportions of water, sodium carbonate, and sodium silicate in said aqueous bath is of the order of 280:1:4.

8. A process of separating oil from tar sands comprising the steps of: providing crushed tar sands containing entrapped oil; mixing as a mixture a non-aqueous, hydrocarbon, tar-oil viscosity-reducing diluent with said tar sands to reduce the viscosity and specific gravity of said oil; providing an aqueous bath of ambient temperature not greater than 100° F. for receiving said tar sands, said aqueous bath being provided with a wetting agent and having a specific gravity greater than 1, greater than that of said oil as diluted and not exceeding 1.01, whereby to permit silt and residual sands of said tar sands to be settled out, and directly introducing said mixture into said aqueous bath.

* * * * *

UNITED STATES PATENT OFFICE

CERTIFICATE OF CORRECTION

Patent No. 4,017,377 Dated April 12, 1977

Inventor(s) JOHN B. FAIRBANKS, JR., and GARY C. BRIMHALL

It is certified that error appears in the above-identified patent and that said Letters Patent are hereby corrected as shown below:

Col. 1, line 20, change "hear" to read --heat--.
line 23, change "prevents" to read --provides--.
line 62, change "prevent" to read --present--.
Col. 2, line 25, delete "is providing" and insert --has proven--
Col. 3, line 12, change "of", first occurrence, to read --or--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*